US012029936B2

(12) United States Patent
Hunt et al.

(10) Patent No.: US 12,029,936 B2
(45) Date of Patent: Jul. 9, 2024

(54) NECK EXERCISE DEVICE AND SYSTEM

(71) Applicants: Thomas Harrison Hunt, Leesburg, VA (US); Zachary Wyatt Elam, San Antonio, TX (US)

(72) Inventors: Thomas Harrison Hunt, Leesburg, VA (US); Zachary Wyatt Elam, San Antonio, TX (US)

( * ) Notice: Subject to any disclaimer, the term of this patent is extended or adjusted under 35 U.S.C. 154(b) by 272 days.

(21) Appl. No.: 17/322,867

(22) Filed: May 17, 2021

(65) Prior Publication Data

US 2022/0111244 A1 Apr. 14, 2022

Related U.S. Application Data

(63) Continuation-in-part of application No. 14/477,827, filed on Sep. 4, 2014, now Pat. No. 11,007,405.

(60) Provisional application No. 61/873,417, filed on Sep. 4, 2013.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/025*** | (2006.01) |

(52) U.S. Cl.

CPC ..... *A63B 21/4003* (2015.10); *A63B 21/0442* (2013.01); *A63B 21/0557* (2013.01); *A63B 21/4025* (2015.10); *A63B 23/025* (2013.01); *A63B 2209/10* (2013.01); *A63B 2225/09* (2013.01)

(58) Field of Classification Search

CPC ..... A63B 23/025; A63B 21/0407; A63B 21/0557; A63B 21/4025; A63B 21/0442; A63B 21/40–4003; A63B 2209/10; A63B 2225/09

See application file for complete search history.

(56) References Cited

U.S. PATENT DOCUMENTS

| | | | | | |
|---|---|---|---|---|---|
| 1,517,147 | A * | 11/1924 | Burnett | A63B 23/025 | 482/129 |
| 1,543,346 | A * | 6/1925 | Titus | A63B 23/025 | 482/10 |
| 2,051,366 | A * | 8/1936 | Catron | A63B 23/025 | 482/110 |
| 5,336,139 | A * | 8/1994 | Miller | A63B 21/0552 | 482/121 |
| 5,505,677 | A * | 4/1996 | Hinds | A63B 21/0004 | 602/17 |
| 5,509,869 | A * | 4/1996 | Miller | A63B 21/4001 | 482/10 |
| 5,626,544 | A * | 5/1997 | Foresto | A63B 21/4017 | 482/93 |
| 6,000,066 | A * | 12/1999 | Williams | A63B 21/4003 | 2/209.13 |
| 6,106,437 | A * | 8/2000 | Brooks | A63B 23/025 | 601/39 |

(Continued)

*Primary Examiner* — Andrew S Lo

(74) *Attorney, Agent, or Firm* — Cygnet IP Law, P.A.; Stephen W. Aycock, II

(57) ABSTRACT

A neck exercise device and system are disclosed. An implementation of the device can include a head harness having an adjustable headband and a first cranial strap having each end attached to the headband. The device can also include a second cranial strap having each end attached to the headband and an adjustable chin strap. The device can further include a plurality of attachment members.

12 Claims, 13 Drawing Sheets

(56) References Cited

U.S. PATENT DOCUMENTS 8,529,269 B2 * 9/2013 Coulombe ..... A63B 69/12 434/254
8,613,690 B1 * 12/2013 Thompson ..... A63B 21/00043 482/10
8,840,528 B2 * 9/2014 Zylstra ..... A63B 21/4025 482/121
9,216,312 B2 * 12/2015 Richardson ..... A63B 21/154
9,789,350 B1 * 10/2017 Wu ..... A63B 21/0442
10,307,636 B1 * 6/2019 Brown ..... A63B 23/025
D853,574 S * 7/2019 Pribila ..... D24/200
2003/0073549 A1 * 4/2003 Hatch ..... A63B 21/065 482/92
2003/0228955 A1 * 12/2003 Makofsky ..... A63B 21/169 482/10
2006/0178224 A1 * 8/2006 DuFour ..... A63B 69/36212 473/276
2007/0004571 A1 * 1/2007 Gonzalez ..... A63B 21/4007 482/124
2007/0032355 A1 * 2/2007 DiGiacomo ..... A63B 21/4015 482/121
2008/0119331 A1 * 5/2008 Zylstra ..... A63B 21/4003 482/10
2009/0318268 A1 * 12/2009 Rosenblum ..... A63B 23/025 482/10
2012/0165169 A1 * 6/2012 Gatherer ..... A61H 1/0218 482/139
2013/0281261 A1 * 10/2013 Gatherer ..... A63B 21/00043 482/8
2014/0051557 A1 * 2/2014 Befeld ..... A63B 23/0211 482/130
2016/0287935 A1 * 10/2016 Sykes ..... A63B 21/4003
2017/0203148 A1 * 7/2017 Askins ..... A63B 21/00185
2017/0239514 A1 * 8/2017 Hunt ..... A63B 21/0442

* cited by examiner

NECK EXERCISE DEVICE AND SYSTEM

RELATED APPLICATIONS

This application is a continuation-in-part of U.S. application Ser. No. 14/477,827, entitled "Neck Exercise Device and System" filed on Sep. 4, 2014, which claims the benefit of U.S. Provisional Application No. 61/873,417, entitled "Neck Exercise Device and System" and filed on Sep. 4, 2013, both of which are incorporated herein by reference in their entirety.

FIELD

Embodiments relate generally to exercise equipment, and more particularly, to neck exercise devices and systems for neck strengthening, conditioning, toning and/or rehabilitation and methods of making the same.

BACKGROUND

Some conventional neck exercise devices, such as traditional weightlifting head harnesses, may include a chain to attach the harness to one or more weights. The chain may be attached to the head harness at two attachment points. Thus, some conventional neck exercise devices may be cumbersome to use and may offer limited exercise options.

Embodiments were conceived in light of the above-mentioned needs, problems and/or limitations, among other things.

SUMMARY

Some implementations can include a neck exercise device comprising a head harness having an adjustable headband and a first cranial strap having each end attached to the headband. The device can also include a second cranial strap having each end attached to the headband and an adjustable chin strap. The device can further include a plurality of attachment members.

The plurality of attachment members can include a first attachment member disposed adjacent to an area where a first end of the first cranial strap attaches to the headband, and a second attachment member disposed adjacent to an area where a second end of the first cranial strap attaches to the headband. The plurality of attachment members can also include a third attachment member disposed adjacent to an area where a first end of the second cranial strap attaches to the headband, and a fourth attachment member disposed adjacent to an area where a second end of the second cranial strap attaches to the headband.

DETAILED DESCRIPTION

Figure 1:
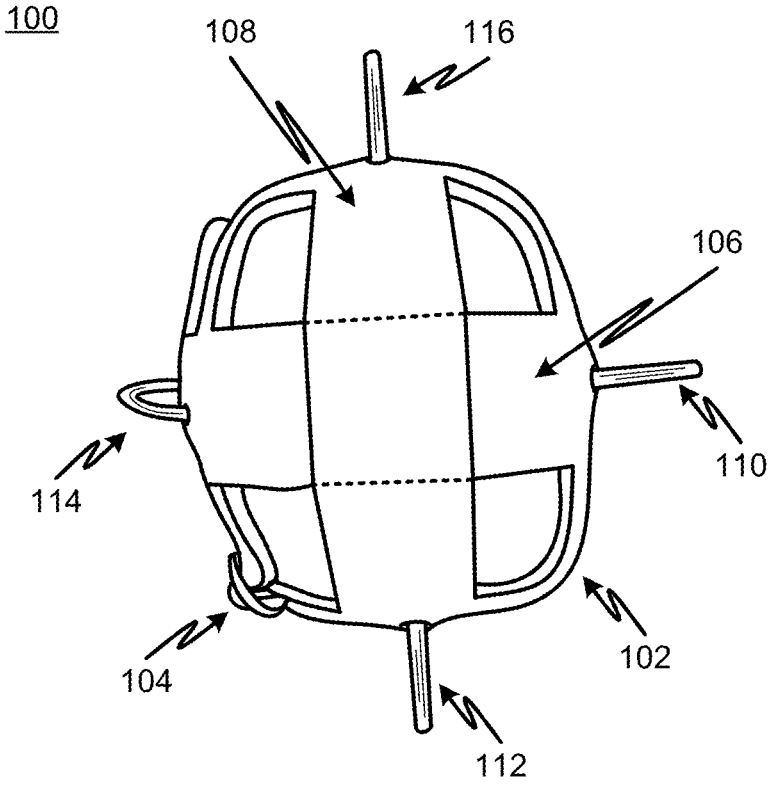
FIG. 1 is a top view diagram of an example neck exercise device in accordance with at least one embodiment.

FIG. 1 shows a top view of an example neck exercise device in accordance with at least one embodiment. In particular, the device 100 includes an adjustable headband 102, a headband adjustment member 104, a first cranial strap 106, a second cranial strap 108, a first attachment member or point 110, a second attachment member or point 112, a third attachment member or point 114, a fourth attachment member or point 116.

The headband 102 and cranial straps 106/108 form a head harness. The headband 102 is configured to extend circumferentially around a user's skull from forehead around the side of the head to the occiput and back around to the forehead. The first cranial strap 106 extends from one side (or temple) region of the skull to the opposite side of the skull and is attached at both ends to the headband 102. The second cranial strap 108 extends from the forehead over the top and crown of the wearer's head to the occipital region and is attached at both ends to the headband. The headband 102 and cranial straps can be formed from 2-inch black heavy polypro webbing or other suitable material. The first cranial strap 106 and second cranial strap 108 can be attached to each other (e.g., stitched together) at a location where the two cross at the crown of the head harness.

The headband 102 includes an adjustment member, which can include a slide (e.g., a 2-inch plastic triglide slide or the like) and 2-inch hook and loop fastener (e.g., Velcro or the like). The attachment members or points can include a 2-inch welded metal D ring (e.g., steel D ring) or other suitable attachment point. Each attachment point 108-116 can be attached to the headband 102 with webbing passing through the attachment point and being secured (e.g., stitched) at each end of the webbing to the headband 102. The attachment points 108-116 (e.g., D rings) can be oriented vertically with respect to the horizontal plane of the headband when being worn, e.g., the D rings can extend from the headband in a similar fashion to the orientation that a human ear extends from the head. It will be appreciated that the D rings could be oriented in other orientations as well. Each attachment member (e.g., D ring) can have an orientation the same as, or different from, the other D rings.

It will be appreciated that although four attachment points are shown in the example embodiment, there could be more or less attachment points in an embodiment.

Some implementations can include a head harness having an adjustable headband, wherein the adjustable headband includes a headband adjustment member and including at least one of a slide portion and a hook and loop portion, and wherein the adjustable headband has a circumferential length along a first axis and a width along a second axis perpendicular to the first axis. The head harness can also include a first cranial strap having each end attached to the adjustable headband and a second cranial strap having each end attached to the adjustable headband. The head harness can further include an adjustable chin strap, wherein the adjustable chin strap includes an adjustment member with an adjustable pad configured to slide along the adjustable chin strap and a plurality of attachment members mounted to the adjustable headband, wherein each attachment member is mounted in between to the adjustable headband and at least one of the first cranial strap and the second cranial strap in a vertical orientation parallel to the second axis, and wherein each attachment ring member is configured to rotate move about the vertical orientation parallel to the second axis an axis in an arc of movement that is less than 180 degrees.

Figure 2:
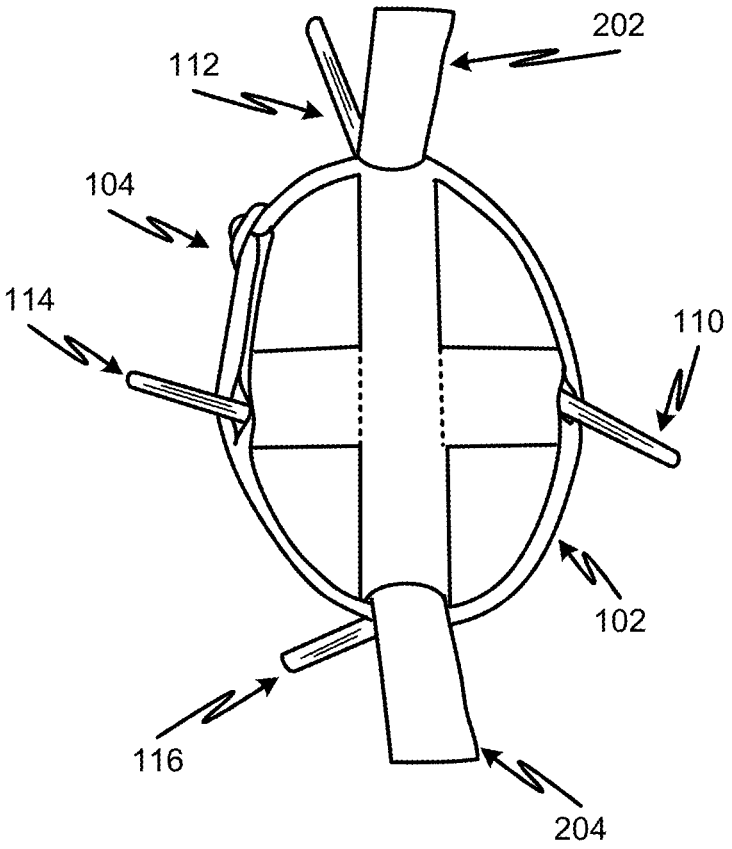
FIG. 2 is a bottom view diagram of an example neck exercise device in accordance with at least one embodiment.

FIG. 2 shows a bottom view of an example neck exercise device in accordance with at least one embodiment. In addition to the elements described above, FIG. 2 shows a chin strap having a first portion 202 and a second portion 204. The chin strap can be formed from 1-inch black heavy polypro webbing or other similar material and attached (e.g., stitched) to the headband 102. The chin strap portions (202 and 204) can each include 1 inch hook and loop fastener to secure the chin strap on a wearer. At least one portion of the chin strap can also include an adjustment member, such as a 1-inch plastic Wide Mouth Heavy duty Triglide Slide (made by YKK), or the like.

In operation, a first chin strap portion can be fed through an adjustment member of the other chin strap portion. The chin strap can be tightened so as to help secure the head harness to a user's head for exercise, and the chin strap can be secured with the hook and loop fastener. One of the chin strap portions can include an adjustable pad configured to slide along the chin strap portion Also, the inside surfaces of the head harness can have padding, such as a 4 mm neoprene with plain backing (or other suitable material) applied (e.g., stitched). The headband and straps can be assembled (e.g., stitched) with heavy duty thread.

Figure 3:
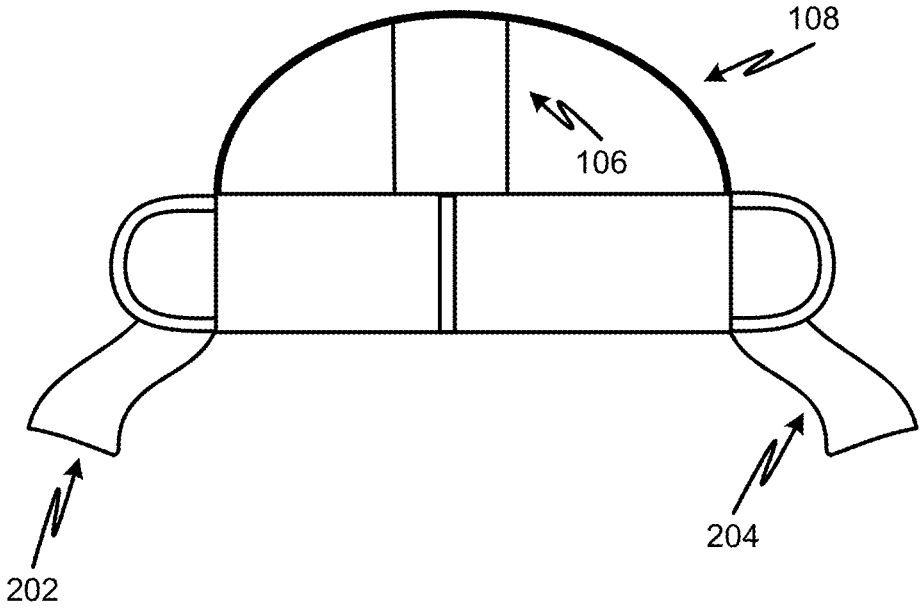
FIG. 3 is a front view diagram of an example neck exercise device in accordance with at least one embodiment.

FIG. 3 shows a front view of an example neck exercise device in accordance with at least one embodiment. In particular, FIG. 3 shows a front view of the neck exercise device with chin straps portions 202/204, and cranial straps 106/108.

Figure 4:
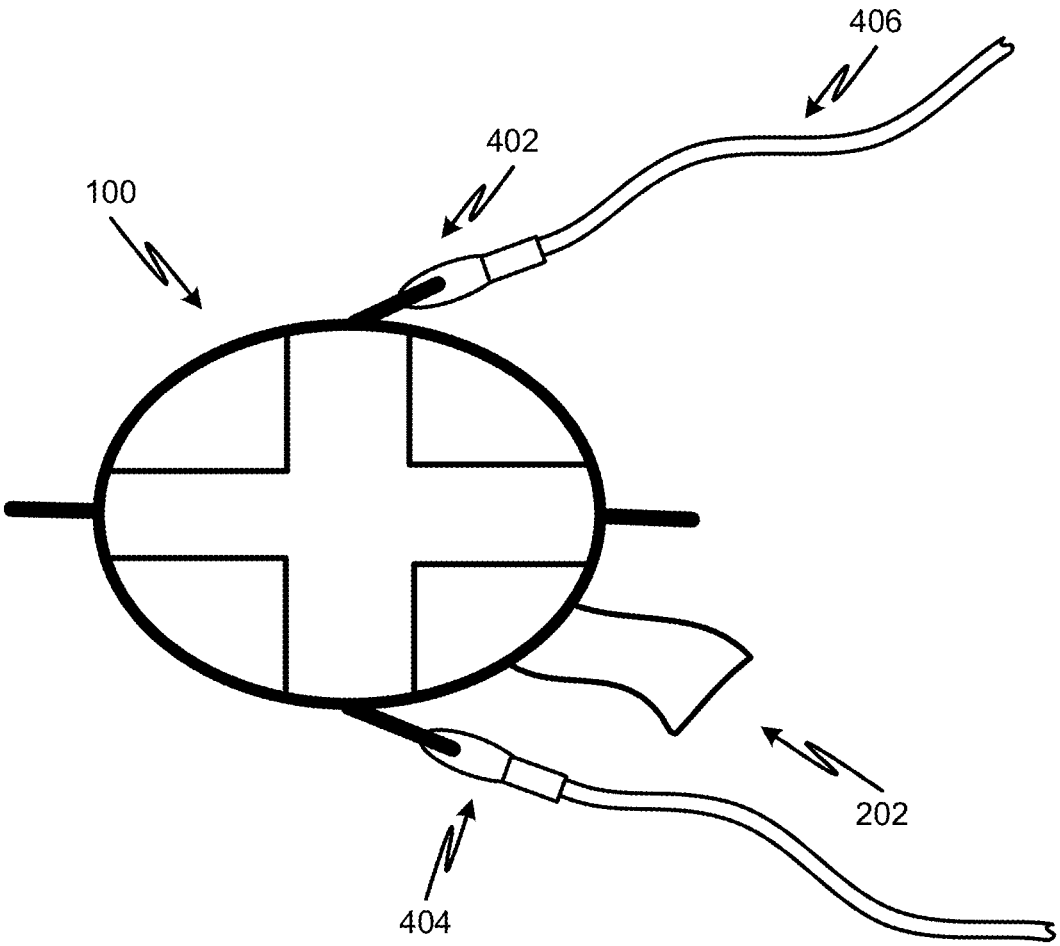
FIG. 4 is a top view diagram of an example neck exercise device in accordance with at least one embodiment.

FIG. 4 shows a top view of an example neck exercise device in accordance with at least one embodiment. In FIG. 4, the head harness 100 is shown with a resistance band 406 (e.g., bungee cord or other suitable elastic material) attached via two carabiners 402/404. The carabiners are configured to attach each end of the resistance band to a respective attachment point (e.g., 110, 114) of the head harness 100. The resistance band 406 can be a single a band with each end having a respective carabiner (402/404) attached.

In operation, one or both ends of the resistance band 406 can be attached to a respective attachment member (e.g., 108-112) and one side or the middle of the resistance band 406 can be temporarily secured (e.g., by hand, foot, wall anchor hook and/or other attachment) and then the head (with the head harness attached) can be moved such that the resistance band 406 generates force against the neck thereby stretching, conditioning and/or strengthening the neck muscles as the head is moved in at least partial opposition to the force of the resistance band 406.

The configuration (e.g., four D rings attached directly to the headband, with one each at the front, rear, left and right sides of the headband respectively) and orientation (e.g., each attachment member being vertically oriented with respect to the horizontal plane of the headband) of the attachment members can provide numerous advantages in terms of the types of resistance that can be provided and, therefore, the types of exercises that can be performed with an embodiment. For example, an exercise can include side to side head (leaning the head toward one of the shoulders) movements with the resistance band ends attached the front attachment member and/or the rear attachment member to provide resistance to the neck. The head movements can include front and back movements (leaning head forward towards the chest and backwards towards the back) with one or both ends of the resistance band attached to the left side attachment member and/or right-side attachment member. The head movements can also include rotational movements with resistance to the neck provided by passing one end of the resistance band through the front attachment member (e.g., D ring) and then through either the right-side attachment member or left side attachment member and finally attaching the end of the resistance band to the rear attachment member. The free end of the resistance band is pulled to the side opposite the side attachment member the band passes through and the head is rotated in a direction opposite the pulled free end of the resistance band thus applying resistance to the rotation of the neck.

Figure 5:
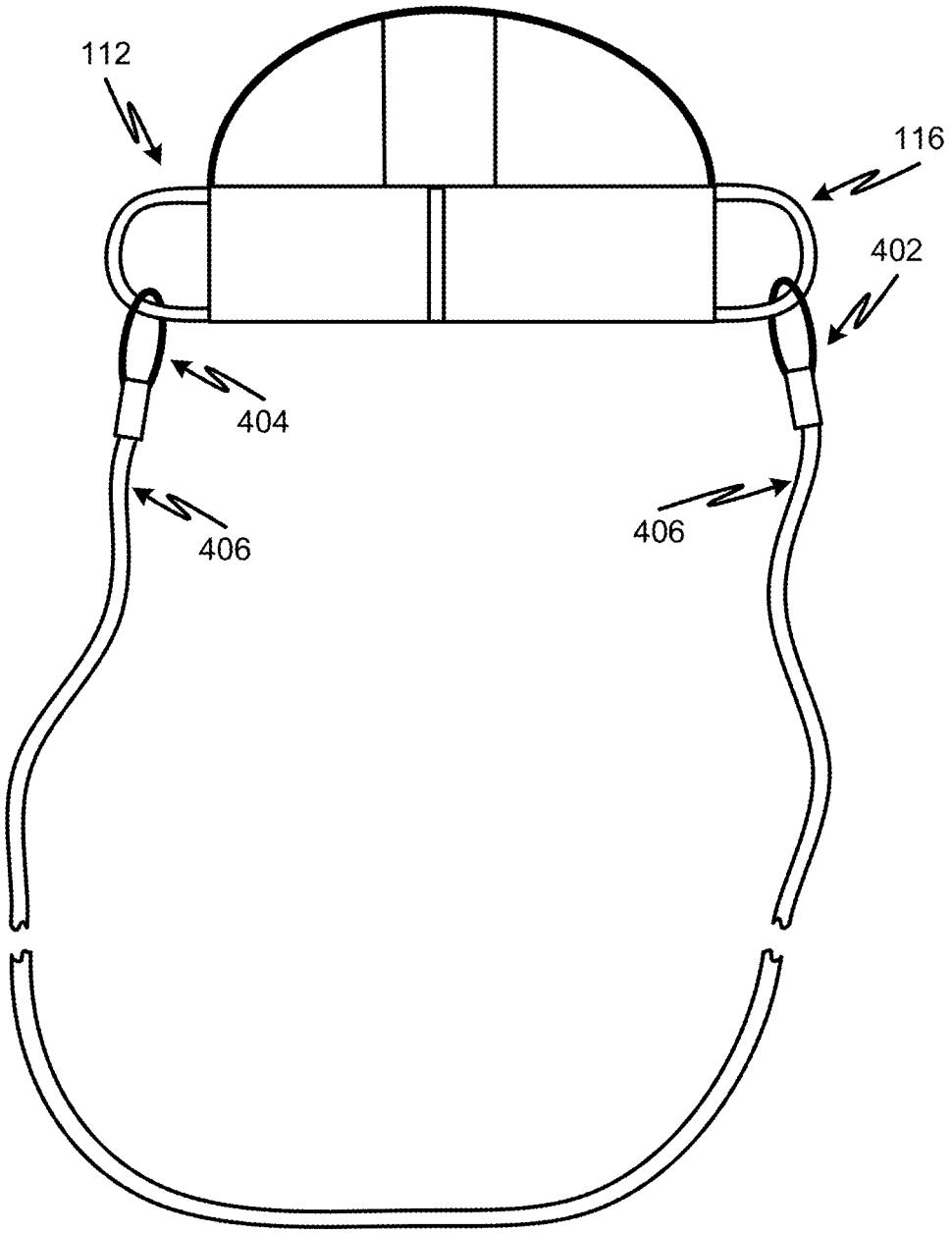
FIG. 5 is a front view diagram of an example neck exercise device in accordance with at least one embodiment.

FIG. 5 shows a front view of an example neck exercise device in accordance with at least one embodiment. FIG. 5 shows the resistance band 406 attached to the head harness via carabiners 402/404 attached to respective attachment points 116/112.

Figure 6:
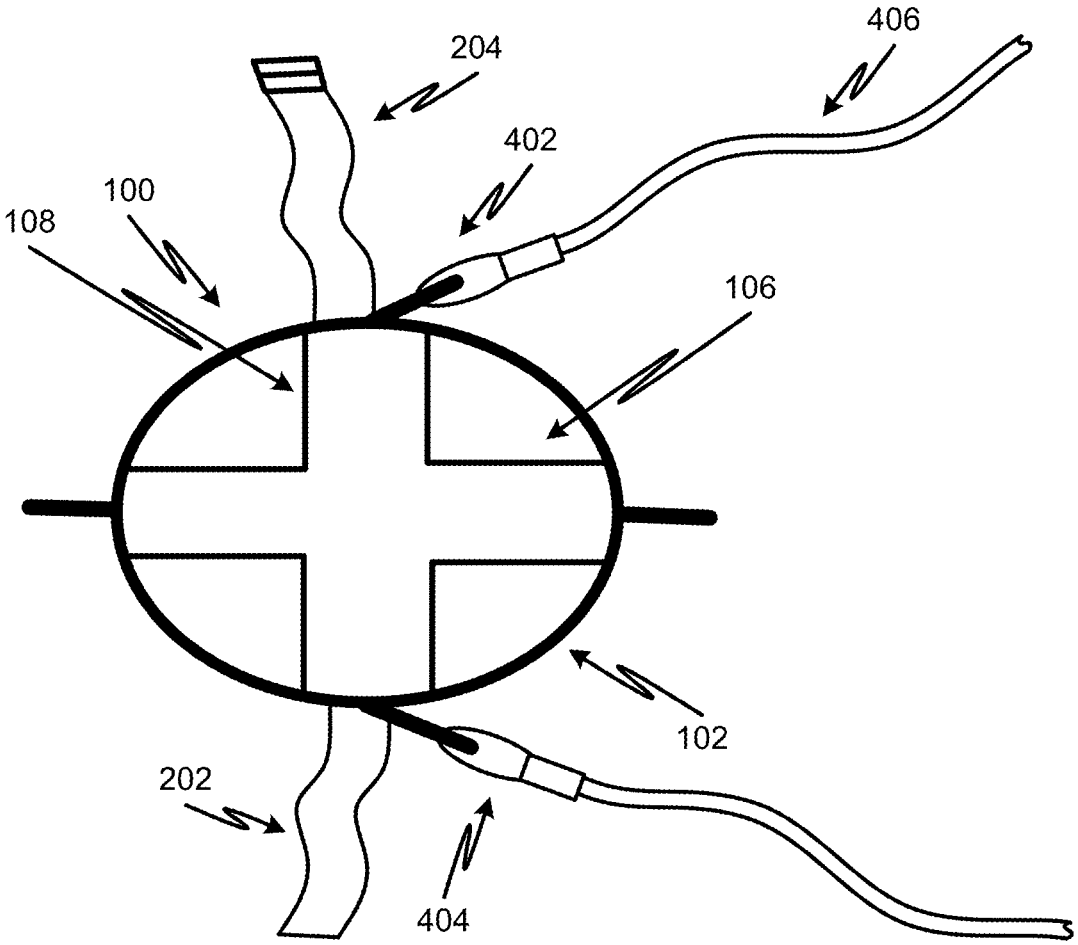
FIG. 6 is a top view diagram of an example neck exercise device in accordance with at least one embodiment.

FIG. 6 shows a top view of an example neck exercise device showing elements described in conjunction with FIGS. 4 and 5.

Figure 7:
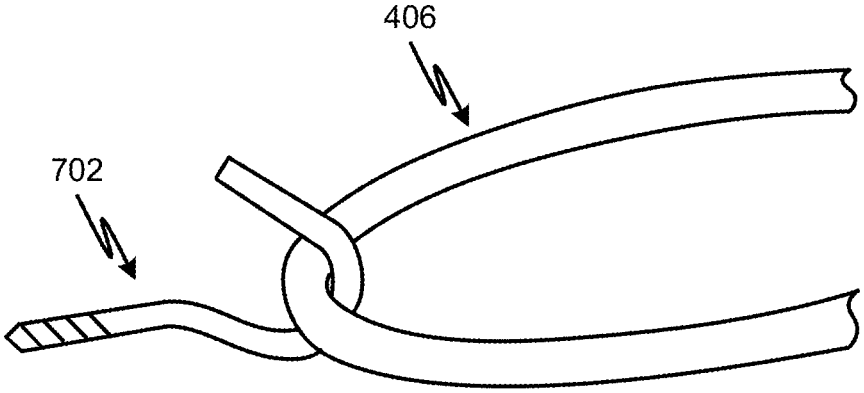
FIG. 7 is a diagram of an example neck exercise device resistance band and wall anchor in accordance with at least one embodiment.

FIG. 7 is a diagram of an example neck exercise device resistance band 406 and wall anchor 702 in accordance with at least one embodiment. The wall anchor can be attached to a wall or other surface to temporarily secure the resistance band 406 for performing one or more neck exercises.

Figure 8:
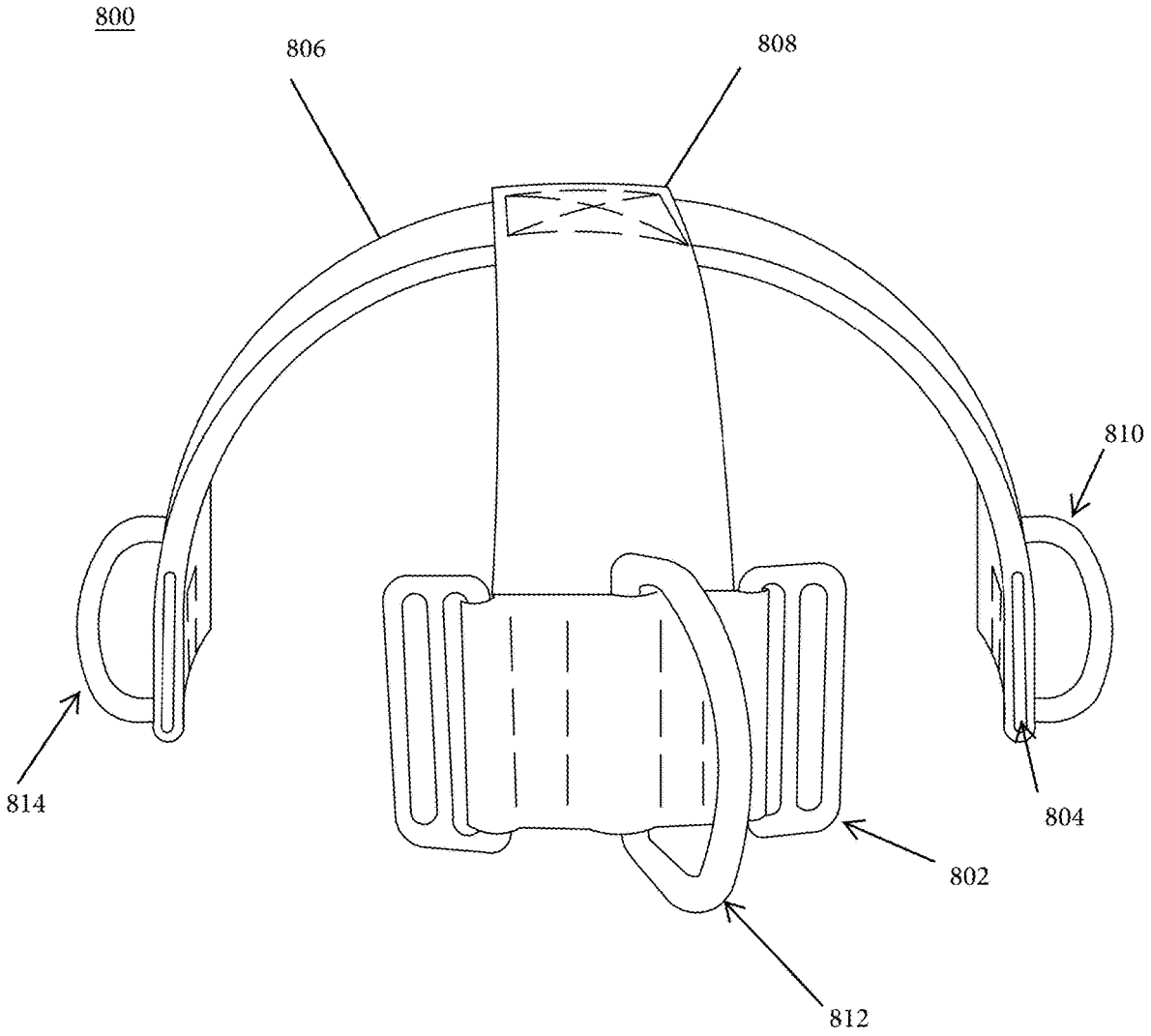
FIG. 8 is a front view diagram of an example neck exercise device head harness in accordance with at least one embodiment.

FIG. 8 shows a front view diagram of an example neck exercise device head harness in accordance with at least one embodiment. The head harness 800 includes a buckle 802, a headband slot 804, a first cranial strap 806, a second cranial strap 808, a first attachment member or point 810, a second attachment member or point 812, and a third attachment member or point 814.

Figure 9A:
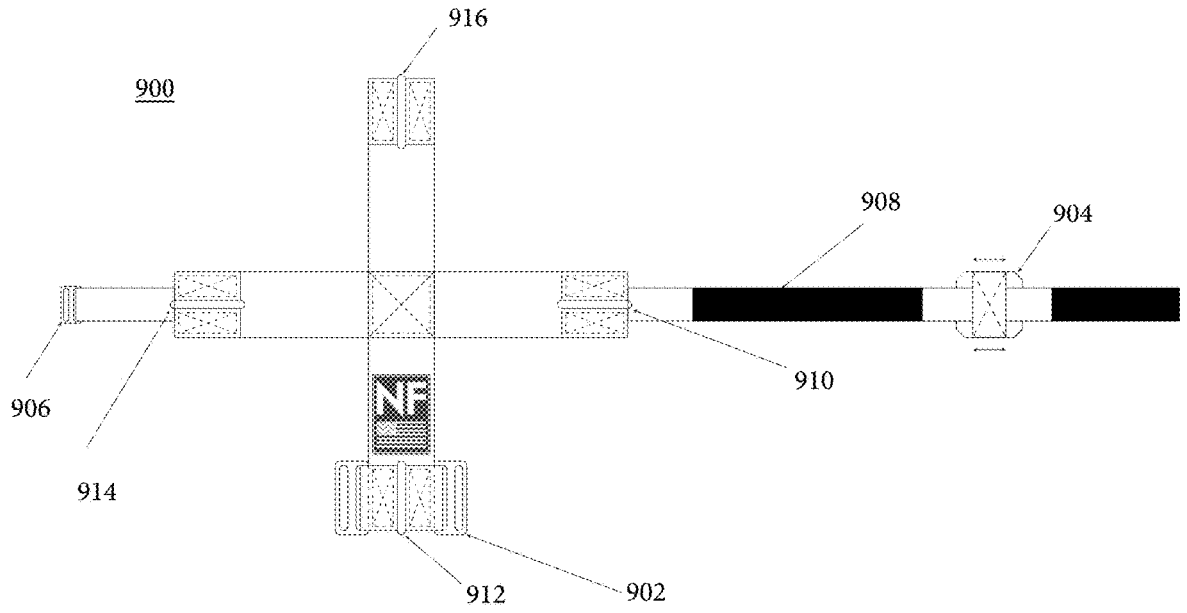
FIG. 9A is a top view diagram of an example neck exercise device head harness with chin strap in accordance with at least one embodiment.

FIG. 9A shows a top view diagram of an example neck exercise device head harness with chin strap in accordance with at least one embodiment. The head harness 900 includes a buckle 902, a chin pad 904, a chin strap buckle 906, a chin strap 908, a first attachment member or point 910, a second attachment member or point 912, a third attachment member or point 914, and a fourth attachment member or point 916.

Figure 9B:
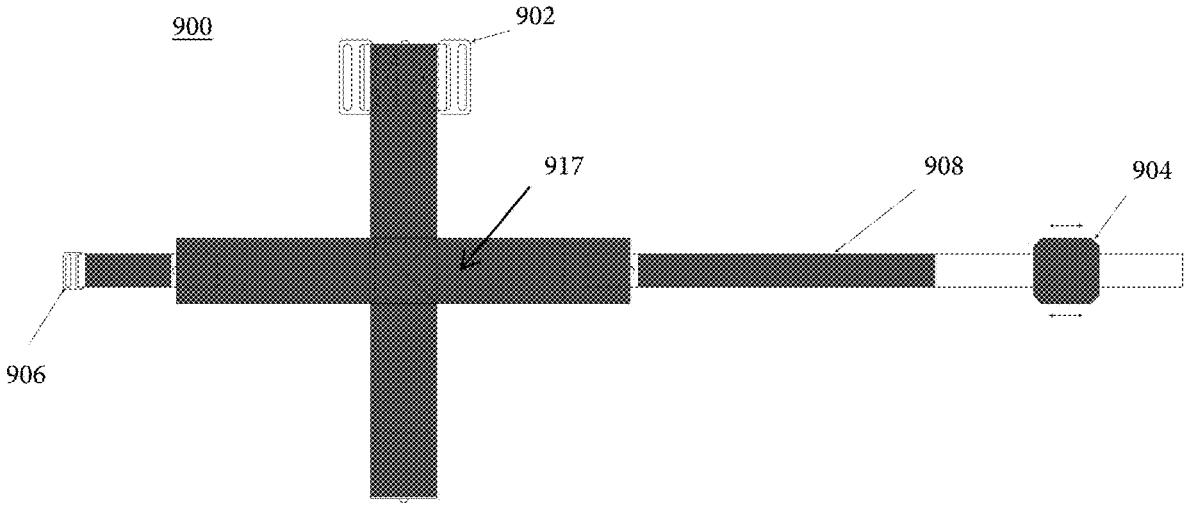
FIG. 9B is a bottom view diagram of an example neck exercise device head harness with chin strap in accordance with at least one embodiment.

FIG. 9B shows a bottom view diagram of an example neck exercise device head harness with chin strap in accordance with at least one embodiment. The head harness 900 includes a buckle 902, a chin pad 904, a chin strap buckle 906, a chin strap 908, and a padded backing 917.

Figure 10A:
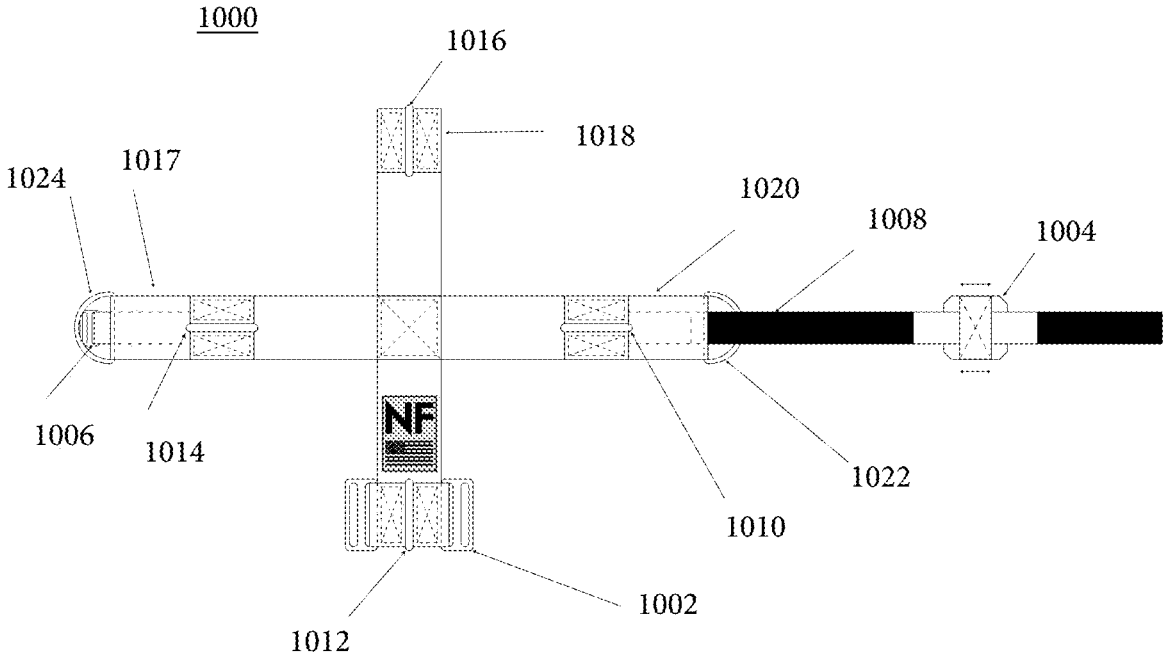
FIG. 10A is a top view diagram of an example neck exercise device head harness with chin strap and chin D ring in accordance with at least one embodiment.

FIG. 10A shows a top view diagram of an example neck exercise device head harness with chin strap and chin D ring in accordance with at least one embodiment. The head harness 1000 includes a buckle 1002, a chin pad 1004, a chin strap buckle 1006, a chin strap 1008, a first attachment member or point 1010, a second attachment member or point 1012, a third attachment member or point 1014, a fourth attachment member or point 1016, a first headband slot 1017, a second headband slot 1018, a third headband slot 1020, a first chin attachment member or point 1022, and a second chin attachment member or point 1024. The chin strap attachment points (1022 and 1024) rotate about an axis parallel to the first axis.

Figure 10B:
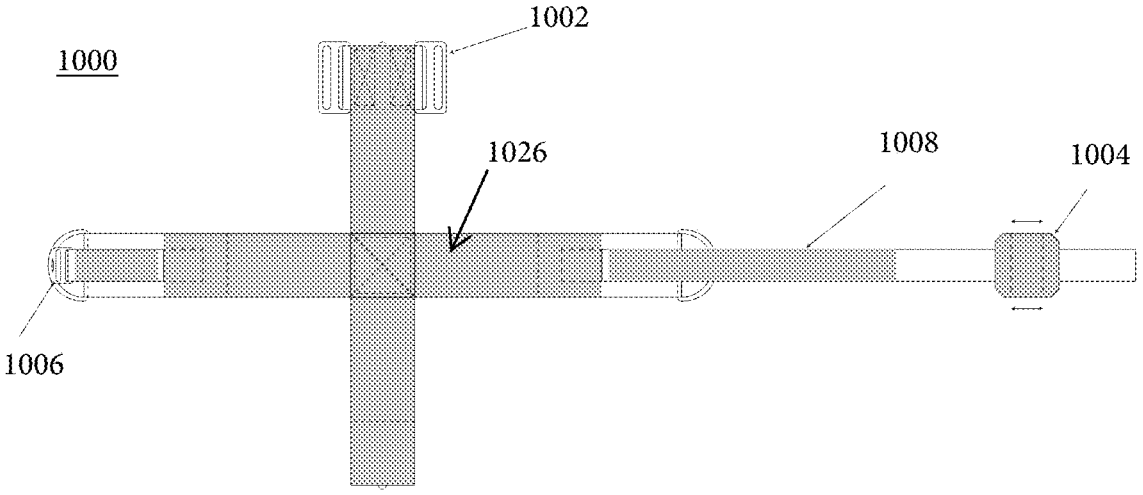
FIG. 10B is a bottom view diagram of an example neck exercise device head harness with chin strap and chin D ring in accordance with at least one embodiment.

FIG. 10B shows a bottom view diagram of an example neck exercise device head harness with chin strap and chin D ring in accordance with at least one embodiment. The head harness 1000 includes a buckle 1002, a chin pad 1004, a chin strap buckle 1006, a chin strap 1008, and a padded backing.

Figure 11A:
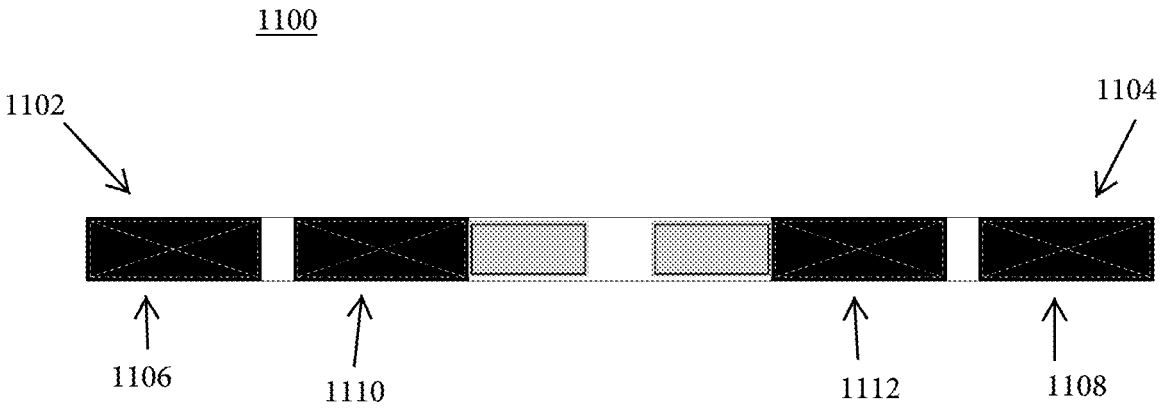
FIG. 11A is a top view diagram of an example neck exercise device headband in accordance with at least one embodiment.

FIG. 11A shows a top view diagram of an example neck exercise device headband in accordance with at least one embodiment. The headband 1100 includes a first end 1102, a second end 1104, a first hook and loop fastener 1106, a second hook and loop fastener 1108, a third hook and loop fastener 1110, a fourth hook and loop fastener 1112 (e.g., Velcro or the like).

Figure 11B:
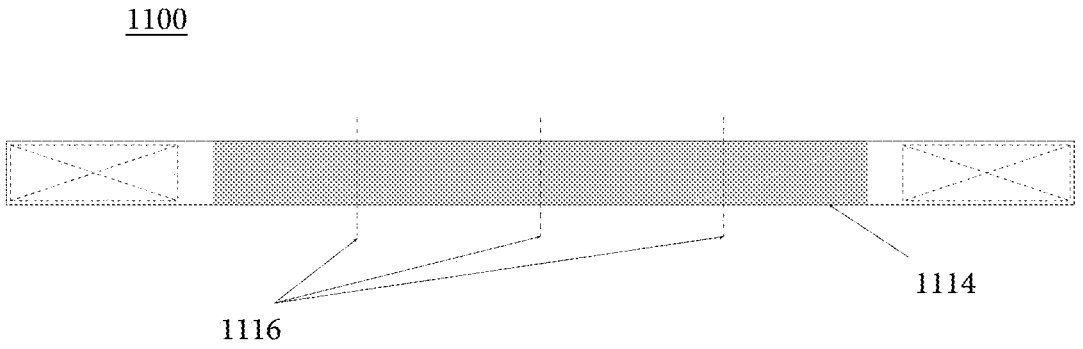
FIG. 11B is a bottom view diagram of an example neck exercise device headband in accordance with at least one embodiment.

FIG. 11B shows a bottom view diagram of an example neck exercise device headband in accordance with at least one embodiment. The headband 1100 includes a padded backing 1114, and an approximate alignment location 1114 of attachment member or point (e.g., 1010, 1014, and 1016).

Figure 12:
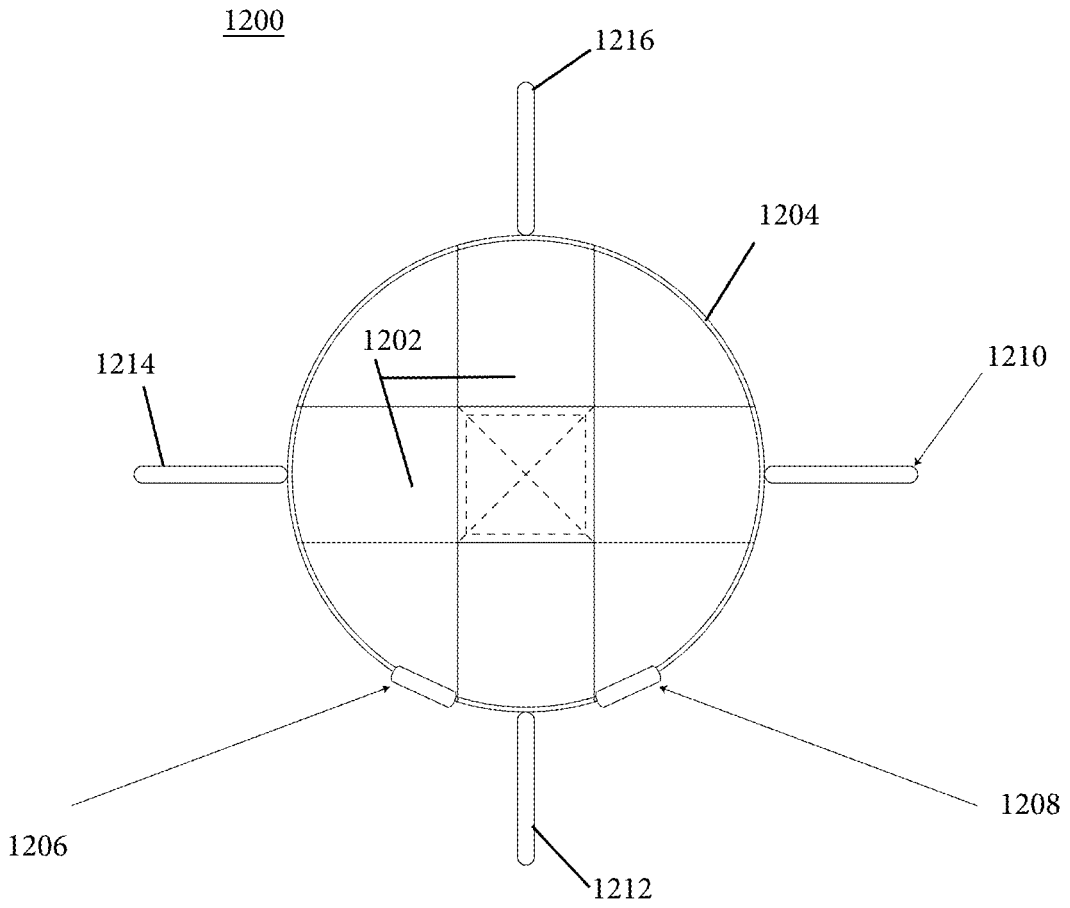
FIG. 12 is a top view diagram of an example neck exercise device in accordance with at least one embodiment.

FIG. 12 shows a top view diagram of an example neck exercise device in accordance with at least one embodiment. The neck exercise device 1200 includes a head harness 1202, a headband 1204, a first buckle 1206, a second buckle 1208, a first attachment member or point 1210, a second attachment member or point 1212, a third attachment member or point 1214, and a fourth attachment member or point 1216.

Figure 13:
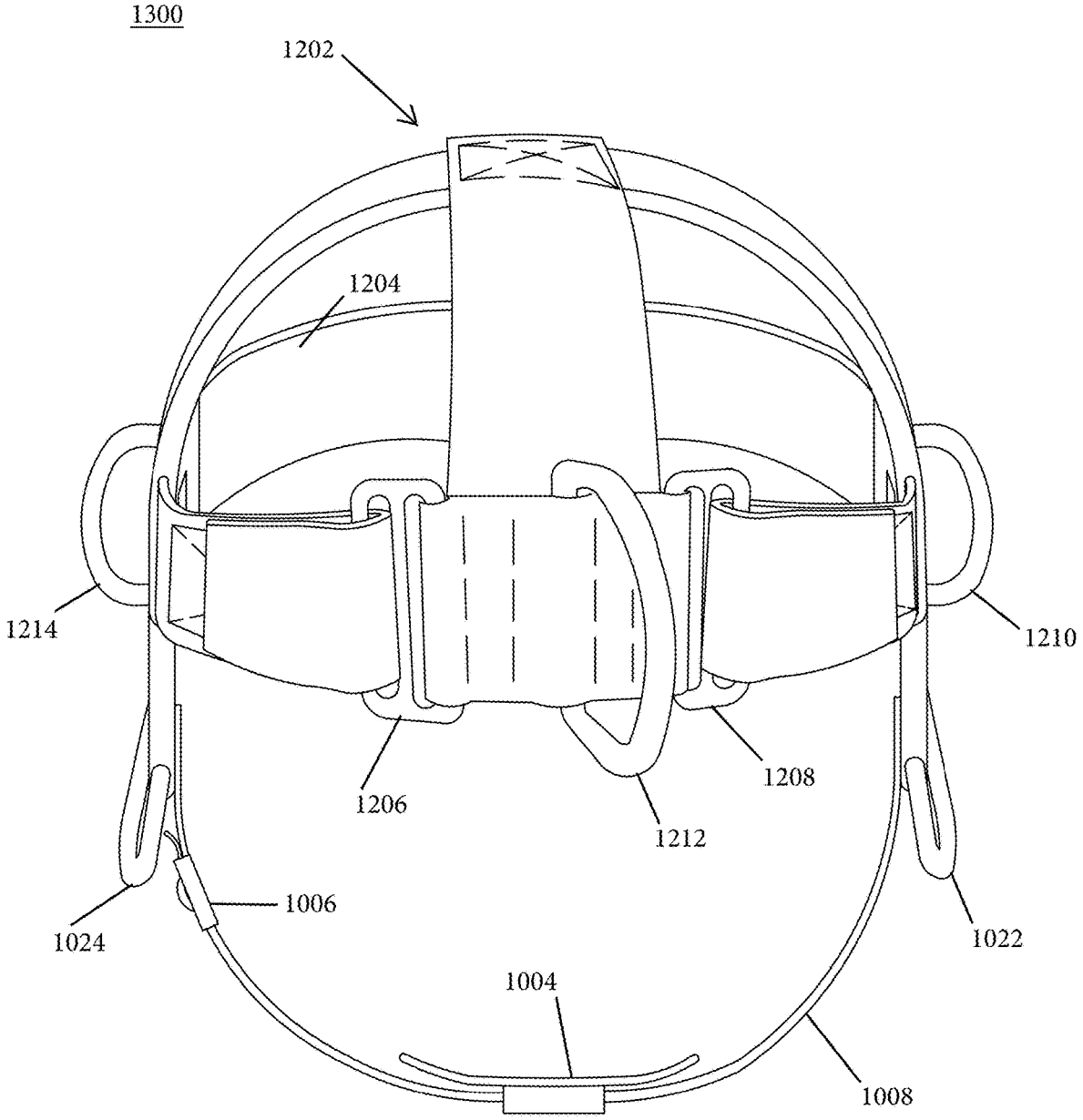
FIG. 13 is a front view diagram of an example neck exercise device in accordance with at least one embodiment.

FIG. 13 shows a front view diagram of an example neck exercise device in accordance with at least one embodiment. The neck exercise device 1300 includes a chin pad 1004, a chin strap buckle 1006, a chin strap 1008, a first chin attachment member or point 1022, a second chin attachment member or point 1024, a head harness 1202, a headband 1204, a first buckle 1206, a second buckle 1208, a first attachment member or point 1210, a second attachment member or point 1212, and a third attachment member or point 1214.

It is, therefore, apparent that there is provided, in accordance with the various embodiments disclosed herein, a neck exercise device and system and method of making the same.

While the disclosed subject matter has been described in conjunction with a number of embodiments, it is evident that many alternatives, modifications and variations would be, or are, apparent to those of ordinary skill in the applicable arts. Accordingly, Applicants intend to embrace all such alternatives, modifications, equivalents and variations that are within the spirit and scope of the disclosed subject matter.

What is claimed is:

1. A neck exercise device comprising:

a head harness having:

a first cranial strap having a first end and a second end, wherein the first end includes a dual layer of material forming a first slot offset from the first end and the second end includes a dual layer of material forming a second slot offset from the second end;

a second cranial strap having a first end and a second end, wherein the second end includes a dual layer of material forming a third slot;

a plurality of first attachment members attached to the first and second cranial straps;

a plurality of second attachment members attached to the first cranial strap;

a first headband buckle attached to a first side of the first end of the second cranial strap;

a second headband buckle attached to a second side of the first end of the second cranial strap opposite the first side of the second cranial strap;

a headband that is adjustable and removable from the neck exercise device; and an adjustable chin strap having a first chin strap portion and a second chin strap portion, the first chin strap portion attached to the first end of the first cranial strap and the second chin strap portion attached to the second end of the first cranial strap.

2. The neck exercise device of claim 1, wherein the plurality of first attachment members includes:

a first attachment member attached to a first point offset from the first end of the first cranial strap;

a second attachment member attached to a second point offset from the second end of the first cranial strap;

a third attachment member attached adjacent to the first end of the second cranial strap; and a fourth attachment member attached adjacent to the second end of the second cranial strap.

3. The neck exercise device of claim 1, wherein the plurality of second attachment members includes:

a first additional attachment member attached at the first end of the first cranial strap; and a second additional attachment member attached at the second end of the first cranial strap.

4. The neck exercise device of claim 1, wherein the headband has a first end and a second end, wherein the headband is configured to slide through the first slot and the second slot at the first end of the first cranial strap, the second end of the second cranial strap, and the second end of the first cranial strap, and wherein each of the first end and the second end is looped through the first and second headband buckles, respectively.

5. The neck exercise device of claim 1, wherein each of the plurality of first attachment members and second attachment members is a metal D-ring.

6. The neck exercise device of claim 1, wherein each of the first plurality of attachment members is mounted to the head harness in a vertical orientation.

7. The neck exercise device of claim 1, wherein each of the second plurality of attachment members is mounted to the head harness in a horizontal orientation.

8. The neck exercise device of claim 4, wherein each end of the headband includes a hook and loop portion.

9. The neck exercise device of claim 1, wherein the adjustable chin strap includes a hook and loop portion and an adjustment member.

10. The neck exercise device of claim 1, wherein the first cranial strap and the second cranial strap are disposed so as to be substantially perpendicular to each other.

11. The neck exercise device of claim 1, wherein the first cranial strap and the second cranial strap are attached to each other.

12. A method of making an exercise apparatus, the method comprising:

forming a head harness by:

providing a first cranial strap having a first end and a second end;

forming, at the first end of the first cranial strap, a dual layer of material to create a first slot offset from the first end;

forming, at the second end of the first cranial strap, a dual layer of material to create a second slot offset from the second end;

providing a second cranial strap having a first end and a second end;

forming, at the second end of the second cranial strap, a dual layer of material to create a third slot;

attaching a plurality of first attachment members to the first and second cranial straps;

attaching a plurality of second attachment members to the first cranial strap;

attaching a first headband buckle to a first side of the first end of the second cranial strap;

attaching a second headband buckle to a second side of the first end of the second cranial strap opposite the first side of the second cranial strap;

providing a headband that is adjustable and removable from the exercise apparatus;

providing an adjustable chin strap having a first chin strap portion and a second chin strap portion;

attaching the first chin strap portion to the first end of the first cranial strap; and attaching the second chin strap portion to the second end of the first cranial strap.

* * * * *